US010609482B2

(12) United States Patent
Goto

(10) Patent No.: US 10,609,482 B2
(45) Date of Patent: Mar. 31, 2020

(54) SPEAKER OPERATION CHECKING DEVICE AND METHOD

(71) Applicant: Yamaha Corporation, Hamamatsu-shi, Shizuoka-Ken (JP)

(72) Inventor: Mitsutaka Goto, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 16/139,283

(22) Filed: Sep. 24, 2018

(65) Prior Publication Data

US 2019/0028805 A1 Jan. 24, 2019

Related U.S. Application Data

(63) Continuation of application No. PCT/JP2017/012052, filed on Mar. 24, 2017.

(30) Foreign Application Priority Data

Mar. 25, 2016 (JP) ..... 2016-062829

(51) Int. Cl.
*H04R 3/00* (2006.01)
*H04R 29/00* (2006.01)

(52) U.S. Cl.
CPC ..... *H04R 3/007* (2013.01); *H04R 29/001* (2013.01); *H04R 2430/01* (2013.01)

(58) Field of Classification Search
CPC .. H04R 2430/01; H04R 29/00; H04R 29/001; H04R 3/00; H04R 3/007
(Continued)

(56) References Cited

U.S. PATENT DOCUMENTS 5,206,912 A * 4/1993 Noro ..... H04R 3/002 381/59
9,084,048 B1 * 7/2015 Gottlieb ..... H04R 3/04
(Continued)

FOREIGN PATENT DOCUMENTS

JP 9-307988 A 11/1997
JP 2013-63706 A 4/2013
JP 2014-93587 A 5/2014

OTHER PUBLICATIONS

International Search Report (PCT/ISA/210) issued in PCT Application No. PCT/JP2017/012052 dated Jun. 20, 2017 with English translation (four pages).
(Continued)

*Primary Examiner* — Vivian C Chin
*Assistant Examiner* — Friedrich Fahnert
(74) *Attorney, Agent, or Firm* — Crowell & Moring LLP

(57) ABSTRACT

A memory previously stores, as reference impedance characteristics, frequency characteristics of impedance of the speaker during a normal operating state of the speaker. During use of the speaker, a detection circuitry detects, as current impedance characteristics, frequency characteristics of impedance of the speaker on the basis of a real-time audio signal being supplied to the speaker. A determination circuitry determines presence/absence of an abnormality of the speaker on the basis of comparison between the detected current impedance characteristics and the stored reference impedance characteristics. Thus, it is possible to check the operation of the speaker based on of the real-time audio signal without using any dedicated test signal. In this way, it is possible to detect presence/absence of an abnormality of the speaker on the basis of a real-time audio signal being supplied to the speaker, for example, during an actual performance in a concert.

14 Claims, 3 Drawing Sheets

(58) Field of Classification Search
USPC ..... 381/58, 59, 96, 111, 116, 117, 190, 396, 381/398, 394, 400, 401, 402, 406, 412
See application file for complete search history.

(56) References Cited

U.S. PATENT DOCUMENTS

2004/0017921 A1* 1/2004 Mantovani ..... H03G 5/22 381/94.9
2009/0273387 A1* 11/2009 Howard ..... H03F 3/187 327/407
2010/0070058 A1* 3/2010 Iwata ..... H03G 5/02 700/94
2012/0014531 A1* 1/2012 Yamkovoy ..... H04M 1/6066 381/71.1
2012/0300949 A1* 11/2012 Rauhala ..... H04R 3/007 381/55
2013/0070932 A1 3/2013 Nyu et al.
2014/0112484 A1* 4/2014 Britt, Jr. ..... H04R 29/001 381/59
2014/0126730 A1* 5/2014 Crawley ..... H04R 29/001 381/59
2014/0177850 A1* 6/2014 Quan ..... H04R 29/001 381/55
2018/0014121 A1* 1/2018 Lawrence ..... H04R 3/007

OTHER PUBLICATIONS

Japanese-language Written Opinion (PCT/ISA/237) issued in PCT Application No. PCT/JP2017/012052 dated Jun. 20, 2017 (four pages).
Japanese-language Office Action issued in counterpart Japanese Application No. 2018-507445 dated May 28, 2019 with unverified English translation (five pages).

* cited by examiner

SPEAKER OPERATION CHECKING DEVICE AND METHOD

BACKGROUND

The present invention relates to a technique for checking operation of a speaker.

In cases where a speaker is used in a concert venue, a theater, or the like, it is common to check operation of the speaker before and/or after use of the speaker. "before and/or after use of the speaker" in a concert venue means, for example, before the start of an actual performance, which is a main feature of the day, in the concert (namely, during preparation for the actual performance) and/or after the end of the concert.

"check operation of the speaker" includes examining whether or not any abnormality, such a failure or another trouble, has occurred in the speaker. Examples of such a speaker abnormality include a disconnection, a short-circuit, a temperature rise of the voice coil, breakage of the cone paper, breakage of the speaker edge, aged deterioration, and the like.

Heretofore, there have been known various speaker operation checking methods. As one example, it has been known to detect an abnormality of a speaker by measuring impedance of the speaker. This speaker operation checking method is arranged to detect, via sensors, an output voltage and an output current between an amplifier output and the speaker, measure impedance on the basis of the detected output voltage and the detected output current, compare the measured impedance and a predetermined value, and then detect an abnormality of the speaker on the basis of a result of the comparison (see, for example, Patent Literature 1 identified below).

However, the conventional technique disclosed in Patent Literature 1 or the like, which is arranged to check the operation of the speaker basically by inputting to the speaker a test signal (such as high-frequency noise) dedicated to the speaker operation checking, is never suited for checking the operation of the speaker during full-scale use of the speaker, such as during an actual performance in the concert. In Patent Literature 1, it is suggested that in a disaster-preventing system, the operation of the speaker can be checked during use of the speaker by mixing the above-mentioned test signal into a sound signal to be input to the speaker. However, even where such a test signal is a signal of a high frequency range difficult for the human ears to hear, it is not preferable at all that the test signal mix into a sound generated from a speaker, in an application where high sound quality of sounds generated from speakers is required, such as in a full-scale speaker system employed in a concert hall or the like. Thus, with the conventional technique, it is not possible to perform a process for detecting an abnormality of a speaker in the middle of, and concurrently with, full-scale use of the speaker, for example, in an application where high audio quality of a sound generated from the speaker is required. Further, with the conventional technique, it is not possible to predict, or know beforehand, occurrence of a failure of the speaker before a failure actually occurs during use of the speaker.

Furthermore, in a speaker system where a plurality of types of speaker units are housed in a single enclosure, such as a "two-way speaker" where two types of speaker units, like a high-frequency-rage (tweeter) speaker and a mid-and-low-frequency-range (mid-bass) speaker, are housed in a single enclosure, the conventional technique disclosed in Patent Literature 1 or the like cannot detect a speaker abnormality while discriminating which one of the speaker units in the enclosure has failed.

Patent Literature 1: Japanese Patent Application Laid-open Publication No. HEI-9-307988

SUMMARY OF INVENTION

In view of the foregoing prior art problems, it is an object of the present invention to enable detection of presence/absence of an abnormality of a speaker and enable prediction of occurrence of a failure of the speaker even during use of the speaker, such as during an actual performance in a concert.

In order to accomplish the aforementioned object, a speaker operation checking device of the present invention includes: a memory that prestores, as reference impedance characteristics, frequency characteristics of impedance of a speaker during a normal operating state of the speaker; detection circuitry that detects, as current impedance characteristics, frequency characteristics of impedance of the speaker based on a real-time audio signal being supplied to the speaker during use of the speaker; and determination circuitry that determines presence/absence of an abnormality of the speaker based on comparison between the current impedance characteristics and the reference impedance characteristics.

According to the present invention, frequency characteristics of impedance of the speaker during a normal operating state of the speaker are stored in advance as the reference impedance characteristics, and frequency characteristics of impedance of the speaker are detected based on a real-time audio signal being supplied to the speaker during use of the speaker. Presence/absence of an abnormality of the speaker is determined based on comparison between the current impedance characteristics and the reference impedance characteristics. Because entire impedance characteristics are compared between the reference impedance characteristics and the current impedance characteristics, an accurate speaker abnormality determination can be performed even when characteristics of the real-time audio signal vary dynamically. In this way, the checking device of the invention can check the operation of the speaker on the basis of the real-time audio signal without using any dedicated test signal, and thus, occurrence of an abnormality of the speaker can be detected even during use of the speaker, such as during an actual performance in a concert. Further, even at a stage where no actual failure has occurred in the speaker yet, a possibility of occurrence of a failure can be detected in real time even during use of the speaker by including possibilities of occurrence of predetermined failures (such as a temperature rise) in abnormality determination conditions. In this way, occurrence of a failure of the speaker can be predicted or known beforehand.

In an embodiment, the speaker operation checking device of the present invention may further include a current memory that stores the current impedance characteristics detected by the detection circuitry, and the current impedance characteristics stored in the current memory are updated with current impedance characteristics detected last or most recently by the detection circuitry. Here, the speaker operation checking device of the invention may be configured in such a manner that when the real-time audio signal being supplied to the speaker is equal to or smaller in level than a predetermined threshold value, the current impedance characteristics stored in the current memory are not updated. Thus, when the level of the real-time audio signal that varies dynamically has decreased or fallen to the predetermined threshold value or below, updating of the stored current impedance characteristics responsive to the fallen level of the real-time audio signal is not executed because the current impedance characteristics detected in response to the fallen level have low reliability for the speaker abnormality determination purposes. In this way, it is possible to perform the speaker abnormality determination while excluding such current impedance characteristics of low reliability. As a result, the speaker operation checking device of the present invention can perform the speaker abnormality determination with a higher accuracy even when characteristics of the real-time audio signal vary dynamically.

The present invention may be constructed and implemented not only as the device invention as discussed above but also as a method invention performed by a computer. Also, the present invention may be constructed as a computer-readable non-transitory storage medium storing a program executable by one or more processors for performing the method.

BRIEF DESCRIPTION OF DRAWINGS

Certain preferred embodiments of the present invention will hereinafter be described in detail, by way of example only, with reference to the accompanying drawings, in which.

DETAILED DESCRIPTION

Now, embodiments of the present invention will be described in detail with reference to the accompanying drawings.

Figure 1:
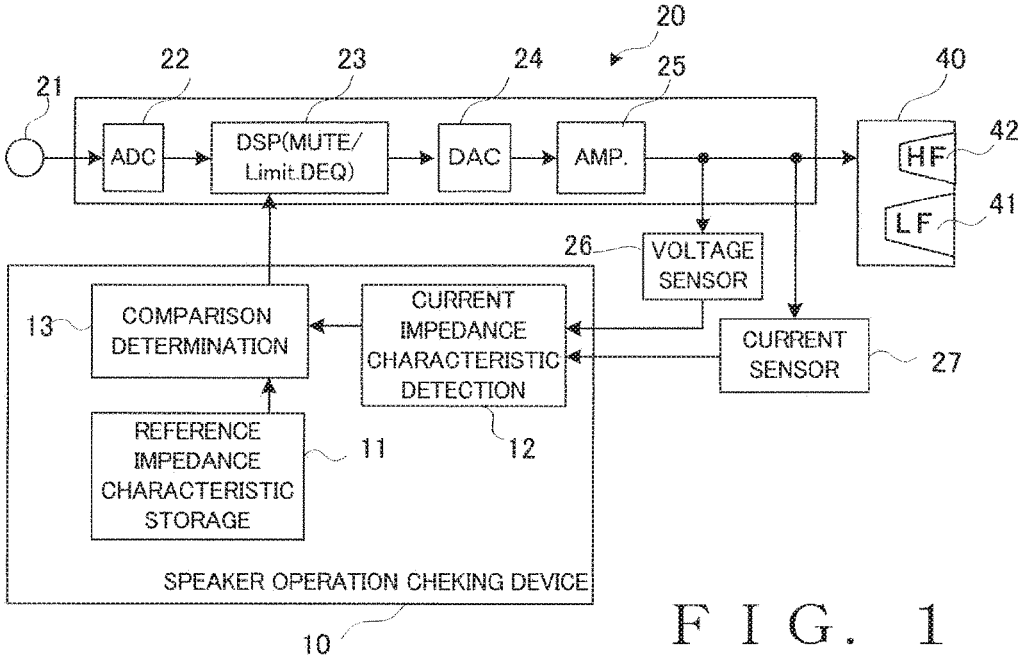
FIG. 1 is a block diagram showing an example general construction of a power amplifier apparatus having a speaker operation checking device of the present invention incorporated therein.

FIG. 1 shows an example of an audio amplifier apparatus having a speaker operation checking device of the present invention incorporated therein. In FIG. 1, an analog audio signal is input from a not-shown sound source to an input terminal 21 of an audio amplifier apparatus 20. The input audio signal is converted into a digital audio signal by an analog-to-digital converter (ADC) 22 and then input to a digital signal processor (DSP) 23. The DSP 23 can perform various processes, including a mute process, a limit process, an equalizer process, etc., on the input digital audio signal. As will be described later, the DSP 23 is used to execute speaker protecting operations in response to detection of an abnormality of the speaker. The digital audio signal output from the DSP 23 is converted into an analog audio signal by a digital-to-analog converter (DAC) 24 and then input to amplification circuitry 25. The amplification circuitry 25 adjusts the level of the analog audio signal in accordance with a volume level set by a not-shown volume control section. The analog audio signal output from the amplification circuitry 25 is supplied to the speaker 40 connected to a not-shown speaker terminal, and the speaker 40 outputs a sound corresponding to the supplied analog audio signal.

The speaker 40 is, for example, a "two-way speaker" where a mid-and-low-frequency range (LF) speaker unit 41 and a high-frequency-range (HF) speaker unit 42 are housed in a single enclosure. High frequency components of the supplied analog audio signal are output from the high-frequency-range speaker unit 42, and mid and low frequency components other than the high frequency components are output from the mid-bass speaker unit 41.

A voltage sensor 26 and a current sensor 27 for monitoring the analog audio signal supplied to the speaker 40 are provided at a stage following the amplification circuitry 25. The voltage sensor 26 detects an analog signal indicative of a voltage level of the analog audio signal output from the amplification circuitry 25. The voltage level output from the voltage sensor 26 is converted into a digital signal by a not-shown ADC and then input to the speaker operation checking device 10. The current sensor 27 detects a current level of the analog audio signal output from the amplification circuitry 25. The current level output from the current sensor 27 is converted into a digital signal by a not-shown ADC and then input to the speaker operation checking device 10.

The speaker operation checking device 10 includes: storage circuitry 11 ("reference impedance characteristic storage circuitry" in FIG. 1) that prestores, as reference impedance characteristics, frequency characteristics of impedance of the speaker 40 during a normal operating state of the speaker 40; detection circuitry 12 ("current impedance characteristic detection circuitry" in FIG. 1) that detects, as current impedance characteristics, frequency characteristics of current impedance of the speaker 40 on the basis of a real-time audio signal being supplied to the speaker 40 during use of the speaker 40; and determination circuitry 13 ("comparison determination circuitry" in FIG. 1) that determines presence/absence of an abnormality of the speaker 40 on the basis of comparison between the detected current impedance characteristics and the stored reference impedance characteristics.

Figure 2:
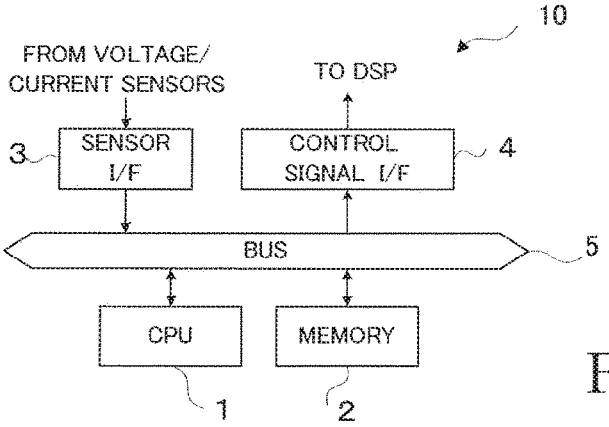
FIG. 2 is a block diagram showing an example electric hardware construction of the speaker operation checking device of the present invention.

The speaker operation checking device 10 is implemented, for example, by a microcomputer device having a function to execute a program for performing operations of the individual circuitry 11, 12, and 13 shown in FIG. 1. FIG. 2 is a block diagram showing an example electric hardware construction of the speaker operation checking device 10. The speaker operation checking device 10 includes a CPU (Central Processing Unit) 1, a memory 2, a sensor interface 3, and a control signal interface 4, and these components are interconnected via a communication bus 5.

The CPU 1 controls operation of the speaker operation checking device 10 by executing various programs stored in the memory 2. The memory 2 includes a ROM (Read-Only Memory) and a RAM (Random Access Memory). Various programs including the program for performing the operations of the individual circuitry 11, 12, and 13 shown in FIG. 1 are stored in the memory 2. Further, the memory 2 constitutes the storage circuitry 11 that stores the reference impedance characteristics. The sensor I/F 3 includes A/D converters such that the I/F 3 takes in the voltage level detected by the voltage sensor 26 and the current level detected by the current sensor 27 after converting the detected voltage level and current level into digital signals. The DSP 23 is connected to the control signal I/F 4 in such a manner that the CPU 1 can supply various control signals to the DSP 23 via the control signal I/F 4.

The reference impedance characteristics stored in the storage circuitry 11 (memory 2) are indicative of frequency characteristics of impedance of the speaker 40 during a normal operating state of the speaker 40. The normal operating state of the speaker 40 means a state in which the speaker 40 is outputting a sound in a normal manner, for example, with no disconnection, short-circuit, temperature rise of the voice coil, breakage or damage of the cone paper, damage of the speaker edge, etc. occurring in the speaker 40. As an example, the reference impedance characteristics may be data of impedance characteristics created on the basis of catalogue specifications of the speaker 40. As another example, the reference impedance characteristics may be data of impedance characteristics measured in advance using a static measuring signal, such as a sine wave signal having a particular frequency. The measurement of the reference impedance characteristics of the speaker 40 may itself be conducted, for example, in accordance with a conventionally known technique where a plurality of measuring signals of different particular frequencies are sequentially swept so as to measure impedance for each of the different particular frequencies.

Figure 3:
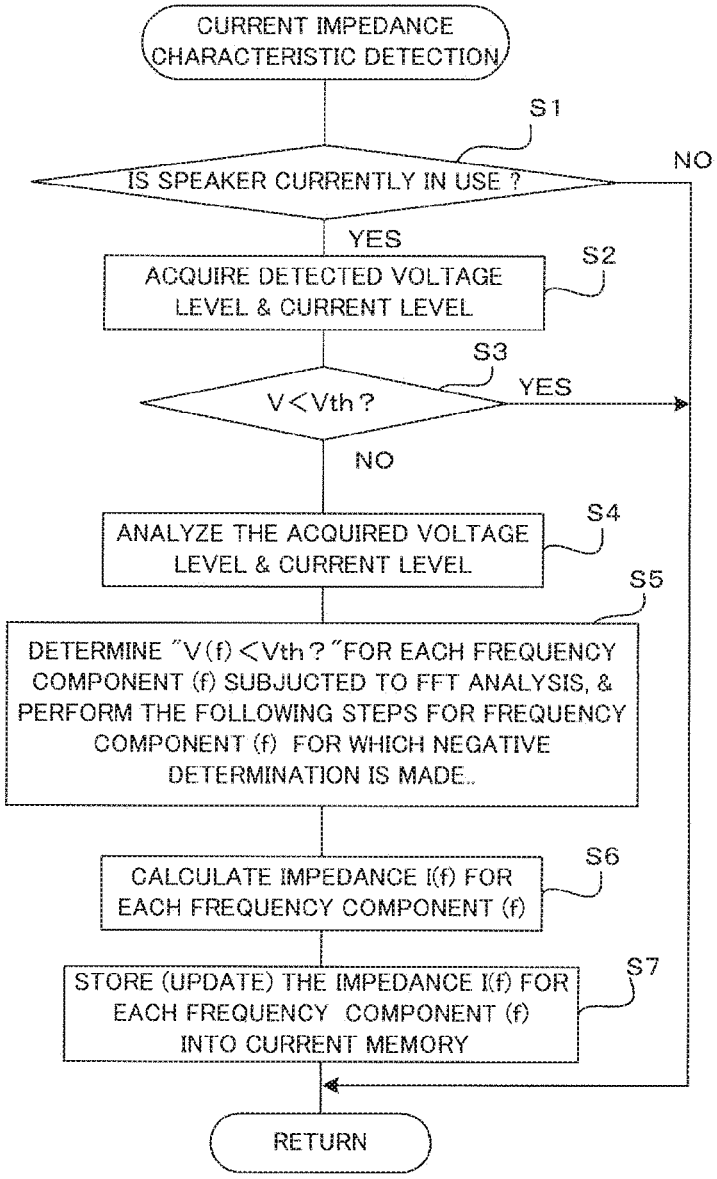
FIG. 3 is a flow chart showing an example of a current impedance characteristic detection process.

The operation performed by the detection circuitry 12 for "detecting current impedance characteristics" may be implemented through software processing by the CPU 1. FIG. 3 is a flow chart showing an example of a current impedance characteristic detection process performed by the CPU 1. The CPU 1 performs the process of FIG. 3 every predetermined detection process period on a timer interrupt basis. First, at step S1, the CPU 1 determines whether or not the speaker 40 is currently in use. That the speaker 40 is currently in use means a state in which the speaker 40 is being actually used (i.e., actually at work) in a concert, a conference, or the like. For example, the CPU 1 may determine that the speaker 40 is currently in use on the basis of detection that the power supply of the audio amplifier apparatus 20 has been turned on, on the basis of detection that the volume control section of the amplification circuitry is currently set at a volume greater than a zero level, or by use of suitable determination logic. In the case where the CPU 1 determines that the speaker 40 is currently in use on the basis of detection that the power supply of the audio amplifier apparatus 20 has been turned on, step S1 may in effect be omitted.

If the speaker 40 is currently in use as determined at step S1, the CPU 1 proceeds to step S2 to acquire data of the voltage level detected by the voltage sensor 26 and data of the current level detected by the current sensor 27. Next step S3 may be omitted because this step is provided as an option, as will be described in detail later. Then, through operations of steps S4 to S6, the CPU 1 detects (calculates) current impedance characteristics of the speaker 40 on the basis of the acquired voltage level and current level. The voltage level and the current level acquired by the detection circuitry 12 is a voltage level and a current level of an analog audio signal being currently supplied to the speaker 40 during use of the speaker 40. The "analog audio signal being currently supplied to the speaker 40 during use of the speaker 40" is indicative of a sound output during ordinary use of the speaker 40, such as a sound performed during an actual performance in a concert that is a main feature of the day in a case where the speaker 40 is used in a concert venue, or a speech voice in a case where the speaker 40 is used in a speech venue. In this specification, a sound output during ordinary use of the speaker 40 will be referred to also as "PGM signal (abbreviation for a program signal)".

Namely, the detection circuitry 12 is characterized by detecting the frequency characteristic of impedance of the speaker 40 on the basis of a current dynamic PGM signal (audio signal) during actual use of the speaker 40, rather than detecting impedance characteristics by use of a measuring signal before or after use of the speaker 40. In this specification, the frequency characteristics of impedance dynamically detected by use of a current PGM signal (audio signal) during use of the speaker 40 will be referred to as "current impedance characteristics". Note that in carrying out the present invention, it is not necessarily necessary to keep the speaker operation checking device 10 operating continuously throughout an entire time period when the speaker 40 is being actually used; rather, it suffices to cause the speaker operation checking device 10 to operate only for a suitable time period (diagnosis period) during actual use of the speaker 40.

As an example, the detection circuitry 12 performs frequency analysis, such as through Fast Fourier Transform (FFT), on the voltage level of the PGM signal acquired from the voltage sensor 26 and the current level of the PGM signal acquired from the current sensor 27, to thereby obtain a frequency spectrum indicative of a voltage level per frequency band (frequency component) included in the PGM signal and a frequency spectrum indicative of a current level per frequency band (frequency component) included in the PGM signal. Namely, the CPU 1 at step S4 performs FFT analysis on the acquired voltage level and current level. Then, the detection circuitry 12 calculates the current impedance characteristics on the basis of the voltage level and current level per frequency range. Namely, the CPU 1 at step S6 calculates impedance I(f) (voltage level÷current level) for each of the frequency components (f) having been subjected to the FFT analysis. Note that step S5 preceding step S6 may be omitted because step S5 is provided as an option as will be described in detail later. The detection circuitry 12 stores the calculated current impedance characteristics into a predetermined current memory (that is set in advance, for example, in the memory 2) as data indicative of the latest current impedance characteristics. Namely, the CPU 1 at step S7 stores the impedance I(f) for each of the frequency components (f) into the memory 2 (updates the memory with the impedance I(f)), as a result of which the current impedance characteristics are generated as a set of impedance I(f) of the plurality of frequency bands (frequency components). In each of the above-mentioned predetermined detection periods, the detection circuitry 12 calculates current impedance characteristics of the speaker 40 based on a PGM signal and updates the current impedance characteristics stored in the memory 2 with the thus-calculated current impedance characteristics. Thus, the detection circuitry 12 can detect current impedance characteristics during use of the speaker 40, such as during an actual performance in a concert, by use of a PGM signal being supplied to the speaker 40.

In an embodiment, when the voltage level V of the PGM signal acquired from the voltage sensor 26 is smaller than a predetermined threshold value (minimum prescribed value) Vth, the detection circuitry 12 may take over (maintain) the immediately preceding current impedance characteristics stored in the current memory (memory 2), without performing the operation of calculating the current impedance characteristics through the Fast Fourier Transform (step S4). For this purpose, step S3 is provided between steps S2 and S4. Namely, at step S3, the detection circuitry 12 compares the voltage level V of the PGM signal acquired from the voltage sensor 26 and the predetermined threshold value (minimum prescribed value) Vth. If V<Vth, the detection circuitry 12 branches to return without proceeding step S4. If not, i.e., if the voltage level V of the PGM signal is equal to or greater than the predetermined threshold value (minimum prescribed value) Vth, the detection circuitry 12 proceeds to step S4 to perform the operations of steps S4 and S5.

Further, in an embodiment, if the voltage levels V(f) of the individual frequency bands (frequency components (f)), obtained as a result of the Fast Fourier Transform performed on the voltage level of the PGM signal acquired from the voltage sensor 26, include any voltage level smaller than the predetermined threshold value (minimum prescribed value) Vth, the detection circuitry 12 may take over (maintain) the impedance value of the frequency component (f), having the voltage level smaller than the predetermined threshold value, stored in the current memory (memory 2). For this purpose, step S5 is provided between steps S4 and S6. Namely, at step S5, the detection circuitry 12 compares the voltage level V(f) of each of the frequency components (f) having been subjected to the FFT analysis against the predetermined threshold value (minimum prescribed value) Vth, in such a manner that control is performed as follows. Namely, as regards each frequency component (f) for which "V(f)<Vth?" is YES, i.e., for which the voltage level V(f) is smaller than the predetermined threshold value (minimum prescribed value) Vth, the operations of steps S6 and S7 are not performed. As regards each frequency component (f) for which "V(f)<Vth?" is NO, i.e., for which the voltage level V(f) is equal to or greater than the predetermined threshold value (minimum prescribed value) Vth, on the other hand, the operations of steps S6 and S7 are performed. In other words, the detection circuitry 12 executes the calculation and updating of the impedance I(f) only for each frequency component (f) for which the voltage level V(f) of the PGM signal having been subjected to the FFT analysis is equal to or greater than the predetermined threshold value (minimum prescribed value) Vth. As a modification, the aforementioned operation of step S5 may be moved to between steps S6 and S7. In such a case, storing and updating of the impedance I(f) is not executed at step S7 for the frequency component (f) for which "V(f)<Vth?" is YES as determined at step S5, although the calculation of the impedance I(f) is executed at step S6 for all of the frequency components (f).

With the current impedance characteristic detection using the PGM signal, it may sometimes be not possible to accurately measure the impedance characteristic. However, it is possible to select only impedance characteristics of which accurate detection can be expected and employ the thus-selected impedance characteristics as the current impedance characteristics, by inserting the aforementioned operation of step S3 such that, as a condition for updating the current impedance characteristics, the calculation of the current impedance characteristics is not executed when the voltage level of the PGM signal is small. In this way, the detection circuitry 12 can calculate, as the current impedance characteristics, impedance characteristics corresponding to a substantive PGM signal (audio signal) acquired during use of the speaker and thereby prevent a calculation error of the current impedance characteristics.

Further, the calculation and updating of the impedance I(f) is executed only for each frequency band (frequency component) of which accurate detection can be expected, by inserting the aforementioned operation of step S5 such that the calculation and updating of the impedance I(f) is executed only for each frequency band (frequency component) for which the voltage level V(f) is equal to or greater than the minimum prescribed value. In this way, impedance characteristics that are accurate to a certain degree can be detected through the impedance characteristic detection using the actual PGM signal (audio signal) that may contain frequency components varying variously. Further, the actual PGM signal (audio signal) may contain frequency components varying variously; thus, even for a frequency band (frequency component) for which the calculation of impedance I(f) is not executed because the voltage level V(f) is smaller than the minimum prescribed voltage Vth at a certain time point, it is possible that the voltage level V(f) of the frequency band (frequency component) becomes equal to or greater than the minimum prescribed voltage Vth and the calculation of impedance I(f) is executed at another time point. Thus, current impedance characteristics over the substantially entire audible frequency band can be obtained by the current impedance characteristic calculation and updating operations according to the present embodiment being performed repeatedly over a certain time period. Note that if there is any frequency band of which the impedance has not been updated even after lapse of a certain time length or period, the impedance of that frequency band does not necessarily have to be updated in the current impedance characteristics, because that frequency band is a frequency band that is not being actually output (or actually used) as the PGM signal.

In response to the detection (updating) of the current impedance characteristics by the detection circuitry 12, the comparison determination circuitry 13 compares the detected current impedance characteristics and the reference impedance characteristics stored in the storage circuitry 11. If a result of the comparison satisfies a predetermined abnormality determination condition, the comparison determination circuitry 13 determines that an abnormality has occurred in the speaker 40, namely, the speaker 40 currently has an abnormality. In this way, any abnormality of the speaker 40 can be detected even during use of the speaker 40, such as during an actual performance in a concert.

Further, once any abnormality of the speaker 40 is detected through the aforementioned determination, the comparison determination circuitry 13 outputs a control signal to the DSP 23 in order to take necessary measures corresponding to a type of the detected abnormality. On the basis of the control signal, the DSP 23 performs a process necessary to protect the speaker 40, such as a mute process, a limit process, an equalizer process, or the like.

As an example, in comparing the detected current impedance characteristics and the reference impedance characteristics as above, the comparison determination circuitry 13 may regard that there is no substantive discrepancy (difference) between the compared two impedance characteristics if the discrepancy (difference) between the two is equal to or smaller than a predetermined threshold value (namely, if the discrepancy is within a predetermined dead zone), and may regard that there is a substantive discrepancy between the two if the discrepancy is greater than the predetermined threshold value (namely, if the discrepancy is beyond the predetermined dead zone). By thus-setting the dead zone for the discrepancy in the comparison between the current impedance characteristics and the reference impedance characteristics, it is possible to prevent an erroneous determination resulting from a measurement error and/or the like.

Figure 4:
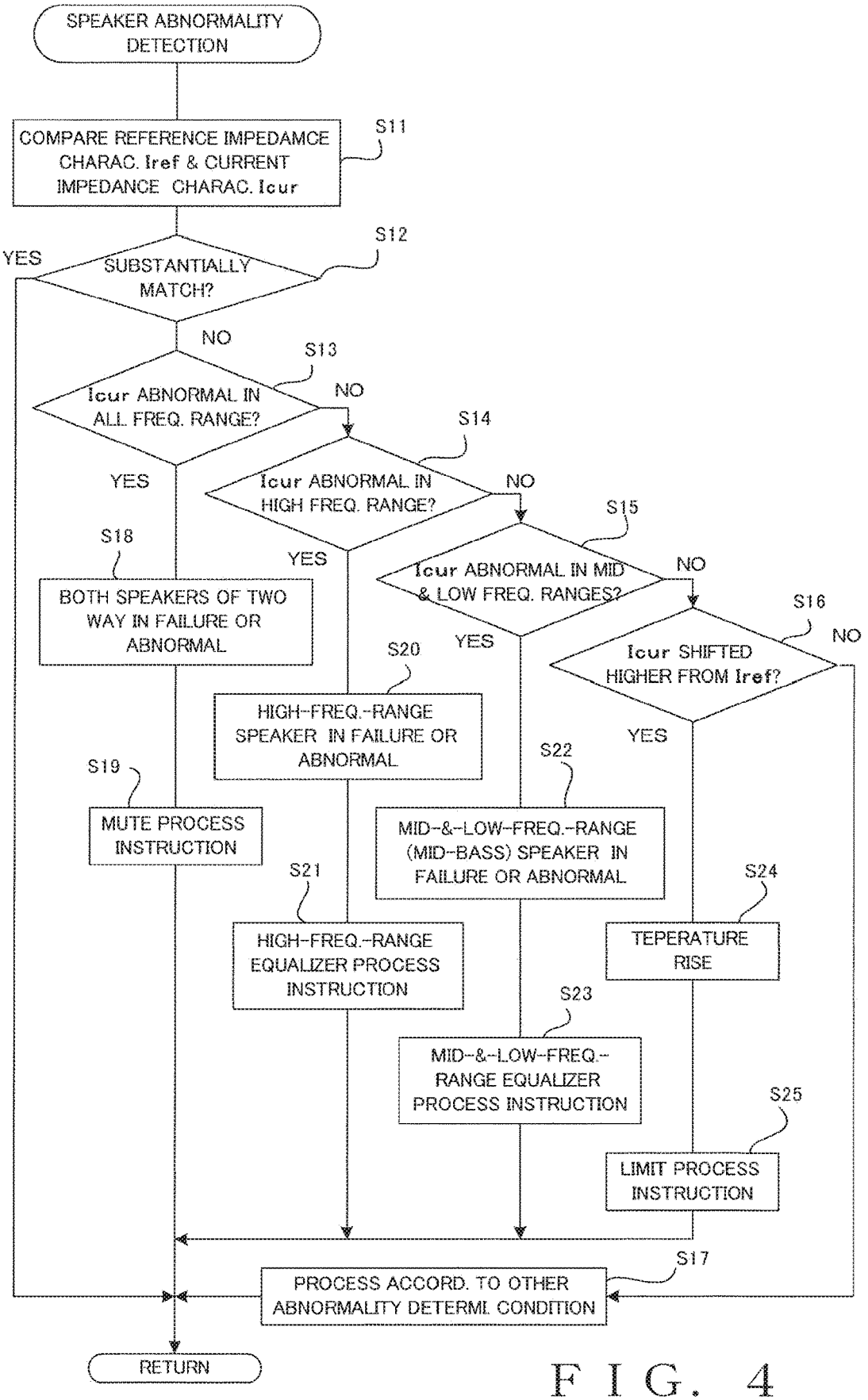
FIG. 4 is a flow chart showing an example of an abnormality determination process.

The operation of the comparison determination circuitry 13 (i.e., speaker abnormality determination process) can be implemented through software processing performed by the CPU 1. FIG. 4 is a flow chart showing an example of the speaker abnormality determination process (processing operation of the comparison determination circuitry 13) performed by the CPU 1. The CPU 1 performs the speaker abnormality determination process of FIG. 4 every predetermined detection process period on a timer interrupt basis. Alternatively, the CPU 1 may perform the process of FIG. 4 each time there has been a change in the current impedance characteristics detected (updated) in the process of FIG. 3.

Figure 5:
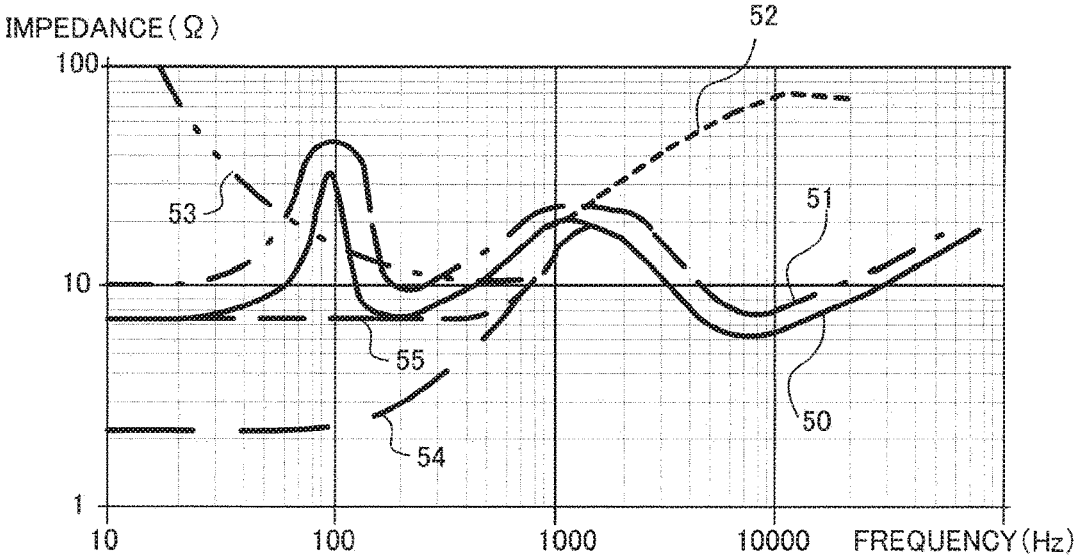
FIG. 5 is a graph showing an example of reference impedance characteristics and several examples of current impedance characteristics.

FIG. 5 is an impedance-vs.-frequency-characteristic graph showing an example of the reference impedance characteristics 50 of the speaker 40 and several examples of current impedance characteristics 51, 52, and 53 (i.e., examples corresponding to several types of abnormalities) at the time of occurrence of an abnormality of the speaker 40. In FIG. 5, the vertical axis represents the impedance, while the horizontal axis represents the frequency.

Now, with reference to FIGS. 4 and 5, a description will be given of the speaker abnormality determination process (processing operation of the comparison determination circuitry 13) and several types of abnormalities that may occur in the speaker 40. First, at step S11 of FIG. 4, the CPU 11 compares the reference impedance characteristics (indicated as "Iref" in FIG. 4) prestored in the memory 2 and the latest current impedance characteristics (indicated as "Icur" in FIG. 4) stored in the current memory (memory 2). At steps S12 to S17, the CPU 1 checks, on the basis of a result of the comparison at step S11, whether any one of a plurality of kinds of predetermined abnormality determination conditions is satisfied or not. At step S12, the CPU 1 determines whether or not the current impedance characteristics (Icur) substantially match the reference impedance characteristics (Iref). When the speaker 40 has no abnormality, the current impedance characteristics based on the actual PGM signal (audio signal) being supplied during use of the speaker 40 substantially match the reference impedance characteristics 50 during the normal operating state as shown in FIG. 5. Thus, if a YES determination is made at step S12, the CPU 1 determines that there is no abnormality in the speaker and then branches to return, ending the speaker abnormality determination process. If a NO determination is made at step S12, on the other hand, the CPU 1 determines at steps S13 to S16 whether any one of the predetermined abnormality determination conditions is satisfied or not.

The CPU 1 is configured to determine, at steps S13 to S16, any one of four typical types of abnormalities of the speaker: (1) a type where abnormalities have occurred in both of the frequency ranges (LF41 and HF42) of the two-way speaker 40; (2) a type where an abnormality has occurred only in the high-frequency-range speaker (HF42); (3) a type where an abnormality has occurred only in the mid-and-low-frequency-range speaker (LF41); and (4) a type where a temperature rise has occurred in the voice coil of the speaker 40.

At step S13, the CPU 1 determines presence/absence of the abnormality of the (1) type mentioned above. In a case where disconnections have occurred in both of the frequency ranges (LF41 and HF42) of the two-way speaker 40, the current impedance characteristics present abnormal characteristics in all of the frequency bands. For example, in a case where disconnections have occurred in all of the frequency ranges, any dynamic impedance characteristic will not be detected in all of the frequency ranges. Thus, the CPU 1 at step S13 checks or determines whether or not the determination condition that the current impedance characteristics currently present an abnormality in all of the frequency ranges is satisfied or not. If a YES determination is made at step S13, the CPU 1 proceeds to step S18, where the CPU 1 determines that the abnormality of the (1) type has occurred (namely, that a failure or abnormality has occurred in both of the frequency ranges of the two-way speaker 40). Then, at step S19, the CPU 1 outputs to the DSP 23 a control signal that instructs the DSP 23 to perform a mute process. Then, the DSP 23 performs the mute process on the basis of the control signal in such a manner that no sound is output from the speaker 40.

If a NO determination is made at step S13, on the other hand, the CPU 1 branches to step S14. At step S14, the CPU 1 determines presence/absence of the abnormality of the (2) type mentioned above. In a case where an abnormality has occurred in the high-frequency-range speaker HF42 of the two-way speaker 40, the current impedance characteristics (Icur) present abnormal characteristics in the high frequency range although, in the normal mid and low frequency ranges, the current impedance characteristics (Icur) present similar characteristics to the reference impedance characteristics. In a case where the abnormality of the high-frequency-range speaker HF42 is a disconnection, for example, the current impedance characteristics (Icur) rise, as a whole, in the high frequency range. An example of such a state where impedance characteristics in the high frequency range of the current impedance characteristics present an abnormality caused by a disconnection (i.e., where the impedance characteristics rise, as a whole, in the high frequency range) is indicated by reference numeral 52 in FIG. 5. Thus, at step S14, the CPU 1 checks or determines whether or not the determination condition that the impedance characteristics in the high frequency range of the current impedance characteristics (Icur) present an abnormality although the current impedance characteristics (Icur) are substantially similar to the reference impedance characteristics (Iref) in the mid and low frequency ranges. If a YES determination is made at step S14, the CPU 1 proceeds to step S20, where the CPU 1 determines that the abnormality of the (2) type has occurred (namely, that a failure or abnormality has occurred only in the high-frequency-range speaker HF42). Then, at step S21, the CPU 1 outputs to the DSP 23 a control signal that instructs the DSP 23 to perform an equalizer process for attenuating sound volume of the high frequency range. By performing the equalizer process on the basis of the control signal, the DSP 23 attenuates the sound volume of the high pitch range or cuts down the sound of the high pitch range in such a manner that the sound is not output.

If a NO determination is made at step S14, the CPU 1 branches to step S15. At step S15, the CPU 1 determines presence/absence of the abnormality of the (3) type mentioned above. In a case where an abnormality has occurred in the mid-and-low-frequency-range speaker LF41 of the two-way speaker 40, the current impedance characteristics (Icur) present abnormal characteristics in the mid and low frequency ranges although the current impedance characteristics (Icur) are generally similar to the reference impedance characteristics in the high frequency range. In a case where the abnormality of the mid-and-low-frequency-range speaker LF41 is a disconnection, for example, the current impedance characteristics (Icur) rise, as a whole, in the mid and low frequency ranges. An example of such impedance characteristics when the mid-and-low-frequency-range speaker LF41 has the disconnection is indicated by reference numeral 53 in FIG. 5. In a case where the abnormality of the mid-and-low-frequency-range speaker LF41 is a short-circuit of the voice coil of the speaker LF41, the current impedance characteristics (Icur) fall, as a whole, in the mid and low frequency ranges. An example of such impedance characteristics when the mid-and-low-frequency-range speaker LF41 has the short-circuit is indicated by reference numeral 54 in FIG. 5. Note that because greater electric power is often supplied to the mid-and-low-frequency-range speaker LF41 than to the high-frequency-range speaker HF 42, a failure, such as damage of the cone paper or mechanism section of the speaker LF41, is more likely to occur. In the case of such a failure of the mid-and-low-frequency-range speaker LF41, mechanical characteristics of the speaker 40 change, and thus, resonance characteristics greatly vary from those of from the reference impedance. If the voice coil and the cone paper have been completely disconnected from each other as an extreme example, mechanical resonance is lost, and thus, the current impedance characteristics (Icur) become generally flat in the mid and low frequency ranges. An example of such characteristics that become generally flat in the mid and low frequency ranges is indicated by reference numeral 55 in FIG. 5.

Thus, at step S15, the CPU 1 determines whether the determination condition that impedance characteristics in the mid and low frequency ranges of the current impedance characteristics (Icur) present an abnormality (any one of the abnormal characteristics 53, 54, 55, etc. corresponding to the aforementioned various failures) although impedance characteristics in the high frequency range are generally similar to the reference impedance characteristics (Iref) is satisfied or not. If a YES determination is made at step S15, the CPU 1 proceeds to step S22, where the CPU 1 further determines that the abnormality of the (3) type has occurred (namely, that a failure or abnormality has occurred only in the mid-and-lower-frequency-range speaker LF41). Then, at step S23, the CPU 1 outputs to the DSP 23 a control signal that instructs the DSP 23 to perform an equalizer process for attenuating sound volume of the mid and lower frequency ranges (mid and low pitch ranges). By performing the equalizer process on the basis of the control signal, the DSP 23 attenuates the sound volume of the mid and low pitch ranges or cuts down the sound of the mid and low pitch ranges in such a manner that the sound is not output.

Note that because a crossover frequency between the speakers LF41 and HF42 of the speaker 40 (i.e., a boundary between the high frequency range and the mid and low frequency range) can be obtained from the specifications of the speaker 40 and the like, whether an abnormal frequency range of the current impedance characteristics (Icur) is in the mid and low frequency ranges (LF41) or in the high frequency range (HF42) can be determined on the basis of the crossover frequency in the speaker abnormality determination process performed by the CPU 1 (comparison determination circuitry 13). Note that in the illustrated example of FIG. 5, the crossover frequency is about 1000 Hz. Also note that although a mechanical failure, such as a short-circuit or damage of the cone paper, as indicated by reference numeral 54 or 55 in FIG. 5 may occur in the high-frequency-range speaker HF42 as well, a detailed description of such a mechanical failure is omitted here.

If a NO determination is made at step S15, the CPU 1 branches to step S16. At step S16, the CPU 1 determines presence/absence of the abnormality of the (4) type mentioned above. If a temperature rise has occurred in the voice coil of the speaker 40, the current impedance characteristics present characteristics shifted in a direction where the impedance rises, as a whole, in response to the temperature rise while keeping a shape substantially similar to the shape of the reference impedance characteristics 50 as indicated by reference numeral 51 in FIG. 5. Thus, at step S16, the CPU 1 determines whether the determination condition that the current impedance characteristics (Icur) have been shifted, as a whole, higher from the reference impedance characteristics (Iref) by a predetermined threshold value or over is satisfied or not. If a YES determination is made at step S16, the CPU 1 proceeds to step S24, where the CPU 1 further determines that the abnormality of the (4) type has occurred. Then, at step S25, the CPU 1 outputs to the DSP 23 a control signal that instructs the DSP 23 to perform, for example, a limit process. By performing the limit process on the basis of the control signal, the DSP 23 lowers the sound volume of all of the frequency bands (i.e., overall sound volume level) of the PGM signal (audio signal) to be supplied to the speaker 40. Determining the abnormality of the (4) type as above enables detecting in advance that there is a possibility of the voice coil being cut off due to the temperature rise. Further, by the limit process performed in response to such previous detection, the sound volume level is lowered, as a whole, in such a manner that degree of vibration of the voice coil can be reduced, as a result of which the possibility of the voice coil being cut off can be reduced. In this way, appropriate measures can be taken against the possibility of occurrence of a failure.

If a NO determination is made at step S16, on the other hand, the CPU 1 branches to step S17. At step S17, the CPU 1 further determines whether another abnormality determination condition than the aforementioned abnormality determination conditions is satisfied or not and outputs to the DSP 23 a necessary control signal to instruct the DSP 23 to take appropriate measures corresponding to the determined type of abnormality. The type of abnormality to be determined on the basis of such other abnormality determination condition includes occurrence of a short-circuit in wiring of the speaker, and the like, although a detailed description of such a type of abnormality is omitted here.

Note that the content of the measures (control of the DSP 23) taken at each of steps S19, S21, S23, and S25 upon the determination that an abnormality has occurred in the speaker 40, or the speaker has an abnormality, is not necessarily limited to the aforementioned example. For example, as the process to be performed by the DSP 23 as the measures to be taken against the occurrence of the temperature rise in the speaker 40, a mute process may be performed, or an equalizer process may be performed to attenuate a particular frequency range.

Further, the content of the measures (control of the DSP 23) to be taken at each of steps S19, S21, S23, and S25 of FIG. 4 upon the determination that an abnormality has occurred in the speaker 40 may be either determined in advance in the aforementioned manner, or designated by the user as necessary. As another example, preset data defining content of measures corresponding to types of abnormalities of the speaker 40 (including content of processing corresponding to the types of abnormalities, sound volume attenuation levels which are to be used for the limiter process, the equalizer process, etc., among other things) may be prestored in the memory 2 for each of the models of the speakers, and control based on such preset data may be performed at each of steps S19, S21, S23, and S25 of FIG. 4 (comparison determination circuitry 13) upon the determination that the speaker 40 has an abnormality.

Note that in the present invention described here, the "abnormality of the speaker 40" is not necessarily limited to a state where a failure has actually occurred in the speaker 40 and includes a state where a failure is like to occur in the speaker 40 although a failure has not yet occurred in the speaker 40. Thus, the comparison determination circuitry 13 ("speaker abnormality determination process" by the CPU 1) may be arranged to determine that the speaker 40 currently has an abnormality (or there is currently a possibility of a failure occurring in the speaker 40) when the result of the comparison between the current impedance characteristics and the reference impedance characteristics shows a difference between the two that is indicative of a possibility of a failure occurring in the speaker 40 although the comparison has not identified an apparent failure (such as a disconnection, a short-circuit, or the like) currently occurring in the speaker 40. In this way, a possibility of occurrence of a failure of the speaker 40 can be predicted or known beforehand even during use of the speaker 40, such as during an actual performance in a concert. Once a possibility of occurrence of a failure of the speaker 40 is predicted, the CPU 1 may, for example, make warning display. By the possibility of occurrence of a failure of the speaker 40 being predicted in this manner, the user can take necessary measures before the failure actually occurs in the speaker 40.

The speaker operation checking device 10 of the present invention constructed in the above-described manner achieves the superior advantageous effect of being capable of detecting presence/absence of an abnormality of the speaker (detecting occurrence of a failure or predicting a possibility of occurrence of a failure) by use of a PGM signal even during use of the speaker 40, such as during an actual performance in a concert.

As an example, the speaker operation checking device 10 of the present invention may be constructed in such a manner that the detection of the current impedance characteristics by the detection circuitry 12 and the presence/absence-of-abnormality determination by the comparison determination circuitry 13 is constantly performed during use of the speaker 40, such as during an actual performance in a concert. As another example, the speaker operation checking device 10 may be constructed in such a manner that the detection of the current impedance characteristics by the detection circuitry 12 and the presence/absence-of-abnormality determination by the comparison determination circuitry 13 is performed at predetermined timing during use of the speaker 40. "performed at predetermined timing" means, for example, that the detection of the current impedance characteristics by the detection circuitry 12 and the presence/absence-of-abnormality determination by the comparison determination circuitry 13 is performed every predetermined time, such as every one hour, or upon arrival at a predetermined time point. As still another example, the speaker operation checking device 10 may be constructed in such a manner that the detection of the current impedance characteristics by the detection circuitry 12 and the presence/absence-of-abnormality determination by the comparison determination circuitry 13 is performed in response to an instruction given by the user during use of the speaker 40.

Further, although impedance characteristics measured in advance by use of a static signal dedicated to the measurement may be used as the reference impedance characteristics in the present invention, impedance characteristics dynamically measured by use of a desired PGM signal (audio signal) at the start of use of the speaker 40 and stored into the storage circuitry 11 may be used as the reference impedance characteristics.

Although embodiments of the present invention have been described above in detail, it should be appreciated that the present invention is not necessarily limited to the above-described embodiments and may be modified variously within the scope of the technical idea disclosed in the claims, description and drawings. For example, the speaker operation checking device 10 of the invention may be implemented not only by a microcomputer device incorporated in the audio amplifier apparatus 20, but also by a processor device having a function to execute a program for performing processing operations of the various circuitry 11, 12, and 13 shown in FIG. 1. Alternatively, the speaker operation checking device 10 may be implemented by a dedicated hardware device (integrated circuitry etc.) configured to perform the processing operations of the various circuitry 11, 12, and 13 shown in FIG. 1. For example, the speaker operation checking device 10 can be implemented by a personal computer connected to the audio amplifier apparatus 20 as peripheral equipment of the apparatus 20.

Furthermore, the audio amplifier apparatus 20 may also be constructed to handle audio signals of a plurality of channels. In such a case, the functions of the speaker operation checking device 10, including the voltage sensor 26 and the current sensor 27, are provided for each of the channels.

This application is based on, and claims priority to, JP PA 2016-062829 filed on 25 Mar. 2016 and International Patent Application No. PCT/JP2017/012052 filed on 24 Mar. 2017. The disclosure of the priority applications, in its entirety, including the drawings, claims, and the specification thereof, are incorporated herein by reference.

What is claimed is:

1. A speaker operation checking device comprising:

a memory that prestores, as reference impedance characteristics, frequency characteristics of impedance of a speaker during a normal operating state of the speaker;

sensor circuitry that detects a voltage and an electric current of a real-time audio signal being supplied to the speaker during use of the speaker;

detection circuitry that detects, as current impedance characteristics, frequency characteristics of impedance of the speaker based on the voltage and the electric current of the real-time audio signal detected by the sensor circuitry;

determination circuitry that determines presence/absence of an abnormality of the speaker based on comparison between the current impedance characteristics and the reference impedance characteristics; and a current memory that stores the current impedance characteristics detected by the detection circuitry, the current impedance characteristics stored in the current memory being updated with current impedance characteristics detected last by the detection circuitry;

wherein when the real-time audio signal being supplied to the speaker is equal to or smaller in level than a predetermined threshold value, the current impedance characteristics stored in the current memory are not updated.

2. The speaker operation checking device as claimed in claim 1, wherein the determination circuitry determines that the speaker has no abnormality, based on a result of the comparison indicating that the current impedance characteristics substantially match the reference impedance characteristics.

3. The speaker operation checking device as claimed in claim 1, wherein the determination circuitry determines that an abnormality in a form of a temperature rise has occurred in the speaker, based on a result of the comparison indicating that the current impedance characteristics have been shifted, as a whole, higher from the reference impedance characteristics by a predetermined threshold value or over while maintaining a substantially similar shape to the reference impedance characteristics.

4. The speaker operation checking device as claimed in claim 3, wherein in response to a determination that the abnormality in the form of the temperature rise has occurred in the speaker, the determination circuitry issues an instruction for lowering an overall sound level of the audio signal to be supplied to the speaker.

5. The speaker operation checking device as claimed in claim 1, wherein the speaker includes a plurality of speaker components dedicated to respective ones of a plurality of different frequency ranges, and wherein the determination circuitry determines presence/absence of an abnormality in the speaker components dedicated to the different frequency ranges, based on a result of the comparison between the current impedance characteristics and the reference impedance characteristics made for each of the frequency ranges.

6. The speaker operation checking device as claimed in claim 1, which analyzes frequency components of the real-time audio signal being supplied to the speaker, and which, for each particular one of the analyzed frequency components of which the level of the audio signal is equal to or smaller than a predetermined threshold value, does not update impedance of the particular frequency component in the current impedance characteristics stored in the current memory.

7. A speaker operation checking device comprising:

a memory that prestores, as reference impedance characteristics, frequency characteristics of impedance of a speaker during a normal operating state of the speaker;

sensor circuitry that detects a voltage and an electric current of a real-time audio signal being supplied to the speaker during use of the speaker;

one or more processors configured to:

detect, as current impedance characteristics, frequency characteristics of impedance of the speaker based on the voltage and the electric current of the real-time audio signal detected by the sensor circuitry; and determine presence/absence of an abnormality of the speaker based on comparison between the current impedance characteristics and the reference impedance characteristics; and a current memory that stores the current impedance characteristics detected by the detection circuitry, the current impedance characteristics stored in the current memory being updated with current impedance characteristics detected last by the detection circuitry;

wherein when the real-time audio signal being supplied to the speaker is equal to or smaller in level than a predetermined threshold value, the current impedance characteristics stored in the current memory are not updated.

8. A speaker operation checking method comprising:

prestoring, as reference impedance characteristics, frequency characteristics of impedance of a speaker during a normal operating state of the speaker;

detecting a voltage and an electric current of a real-time audio signal being supplied to the speaker during use of the speaker;

detecting, as current impedance characteristics, frequency characteristics of impedance of the speaker based on the voltage and the electric current of the real-time audio signal;

determining presence/absence of an abnormality of the speaker based on comparison between the current impedance characteristics and the reference impedance characteristics; and storing the current impedance characteristics detected by the detection circuitry into a current memory, the current impedance characteristics stored in the current memory being updated with current impedance characteristics detected last by the step of detecting;

wherein when the real-time audio signal being supplied to the speaker is equal to or smaller in level than a predetermined threshold value, the current impedance characteristics stored in the current memory are not updated.

9. The speaker operation checking method as claimed in claim 8, wherein the step of determining determines that the speaker has no abnormality, based on a result of the comparison indicating that the current impedance characteristics substantially match the reference impedance characteristics.

10. The speaker operation checking method as claimed in claim 8, wherein the step of determining determines that an abnormality in a form of a temperature rise has occurred in the speaker, based on a result of the comparison indicating that the current impedance characteristics have been shifted, as a whole, higher from the reference impedance characteristics by a predetermined threshold value or over while maintaining a substantially similar shape to the reference impedance characteristics.

11. The speaker operation checking method as claimed in claim 10, wherein in response to a determination that the abnormality in the form of the temperature rise has occurred in the speaker, the step of determining issues an instruction for lowering an overall sound level of the audio signal to be supplied to the speaker.

12. The speaker operation checking method as claimed in claim 8, wherein the speaker includes a plurality of speaker components dedicated to respective ones of a plurality of different frequency ranges, and wherein the step of determining determines presence/absence of an abnormality in the speaker components dedicated to the different frequency ranges, based on a result of the comparison between the current impedance characteristics and the reference impedance characteristics made for each of the frequency ranges.

13. The speaker operation checking method as claimed in claim 8, which further comprises analyzing frequency components of the real-time audio signal being supplied to the speaker, and wherein, for each particular one of the analyzed frequency components of which the level of the audio signal is equal to or smaller than a predetermined threshold value, the current impedance characteristics stored in the current memory are not updated with impedance of the particular frequency component.

14. A computer-readable non-transitory storage medium storing a program executable by one or more processors for performing a method for checking operation of a speaker, the method comprising:

prestoring, as reference impedance characteristics, frequency characteristics of impedance of a speaker during a normal operating state of the speaker;

detecting a voltage and an electric current of a real-time audio signal being supplied to the speaker during use of the speaker;

detecting, as current impedance characteristics, frequency characteristics of impedance of the speaker based on the voltage and the electric current of the real-time audio signal;

determining presence/absence of an abnormality of the speaker based on comparison between the current impedance characteristics and the reference impedance characteristics; and storing the current impedance characteristics detected by the detection circuitry into a current memory, the current impedance characteristics stored in the current memory being updated with current impedance characteristics detected last by the step of detecting;

wherein when the real-time audio signal being supplied to the speaker is equal to or smaller in level than a predetermined threshold value, the current impedance characteristics stored in the current memory are not updated.

* * * * *